United States Patent [19]

Glessner

[11] 4,214,613

[45] Jul. 29, 1980

[54] LOOM

[76] Inventor: James S. Glessner, R.D. 2, Somerset, Pa. 15501

[21] Appl. No.: 27

[22] Filed: Jan. 2, 1979

[51] Int. Cl.[3] ..... D03D 29/00

[52] U.S. Cl. ..... 139/33

[58] Field of Search ..... 139/29-33

[56] References Cited

U.S. PATENT DOCUMENTS

| | | | |
|---|---|---|---|
| 2,193,558 | 3/1940 | Gallinger | 139/33 |
| 2,380,233 | 7/1945 | Greenwood | 139/33 |
| 3,774,649 | 11/1973 | Glessner | 139/33 |

*Primary Examiner*—Henry Jaudon

*Attorney, Agent, or Firm*—Brown, Flick & Peckham

[57] ABSTRACT

A lever is pivotally connected to the upper part of a loom frame on a horizontal axis and carries a roller at one end that normally is held by the lever in a predetermined central position and that supports an upper cable that carries a pulley at each end. A lever cable hangs from the other end of the lever and supports a vertically movable floating member. An intermediate cable hangs from each pulley and the four ends of these two cables support four vertically movable harnesses. With a four harness loom, treadles below the harnesses are connected by cables to the harnesses and the floater in such a way that no matter which treadle is depressed the height of the shed will always remain the same.

4 Claims, 10 Drawing Figures

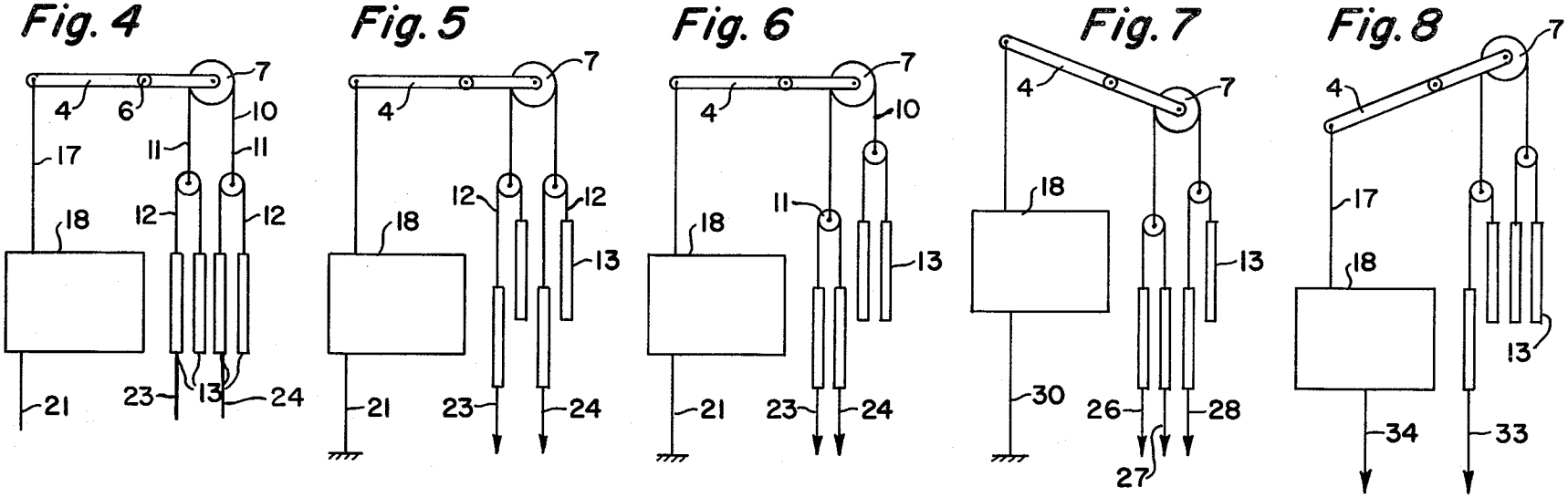
Fig. 4
Fig. 5
Fig. 6
Fig. 7
Fig. 8
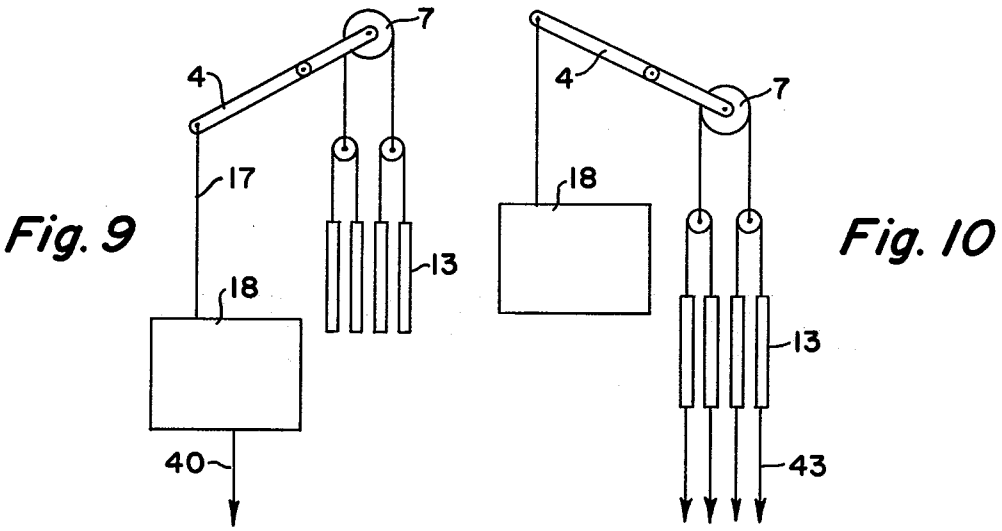
Fig. 9
Fig. 10

LOOM

Counter-balance weaving on a loom with four harnesses has shed regulation problems in unbalanced tie-ups. One against three harnesses or three against one harness creates undefined and diminished shed openings. Also, counter-balance weaving in more than a four harness loom is limited in the number of patterns it can make because of the very balanced nature in which it works.

Jack-type weaving involves stretched top warp and slack bottom warp when shedding. This causes delicate warp ends to break in the stretched warp, and heavy shuttles to sink in the slack warp. Noise is usually a problem also.

Counter-marche weaving has more complicated tie-ups than any other weaving mode. Each treadle is tied up to every harness, and each harness is forced to either rise or sink. Because one treadle may cause one harness to rise and another treadle may cause that same harness to sink, these two treadles cannont be depressed simultaneously. Therefore, in counter-marche weaving it is impossible to depress more than one treadle at a time.

It is among the objects of this invention to provide a loom which has the advantages of the above three conventional weaving modes, which avoids the disadvantages of those weaving modes and in which the action is smooth, easy and quiet.

The preferred embodiment of the invention is illustrated in the accompanying drawings, in which FIG. 1 is a front view of the loom with some parts omitted for the sake of clearness;

FIGS. 4 to 10 are diagrams illustrating different positions of the harnesses with different tie-ups.

Figure 2:
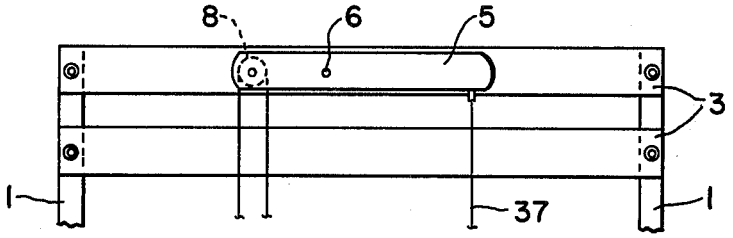
FIG. 2 is a fragmentary rear view of the upper part of the loom.
Figure 1:
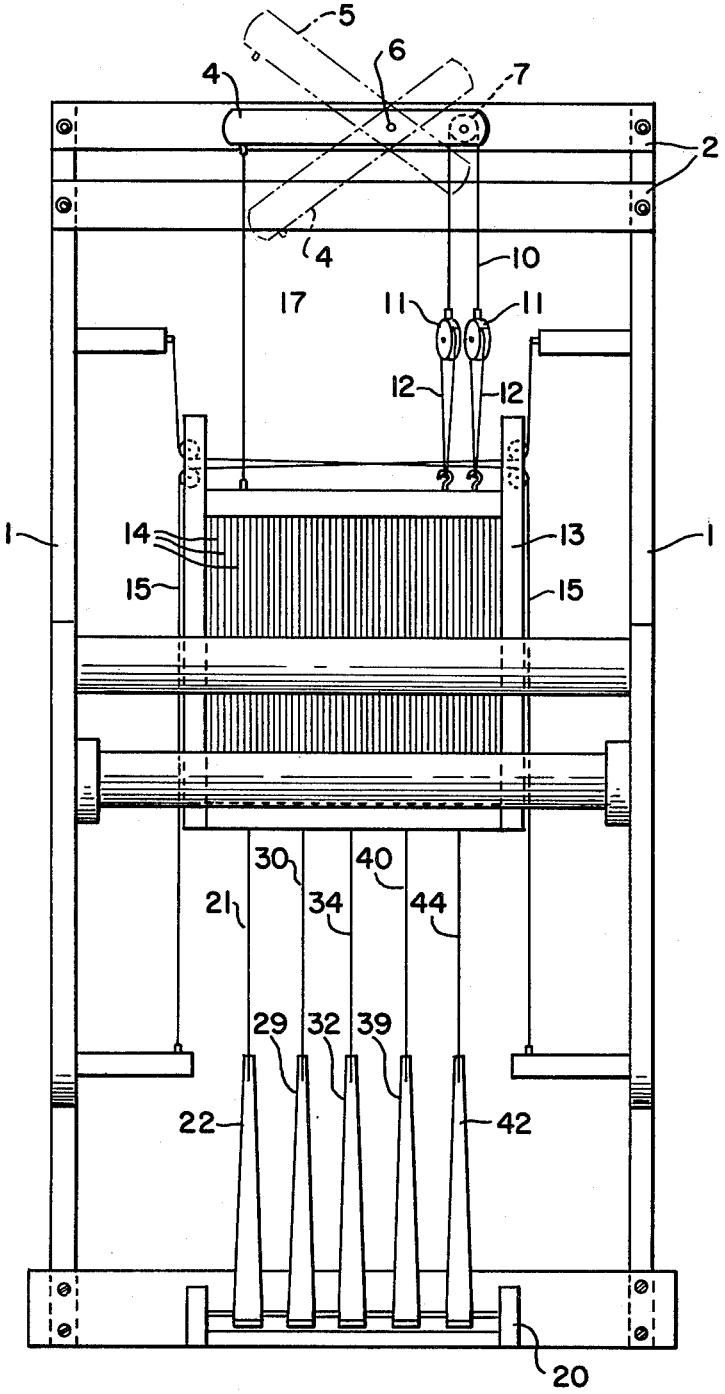
Figure 3:
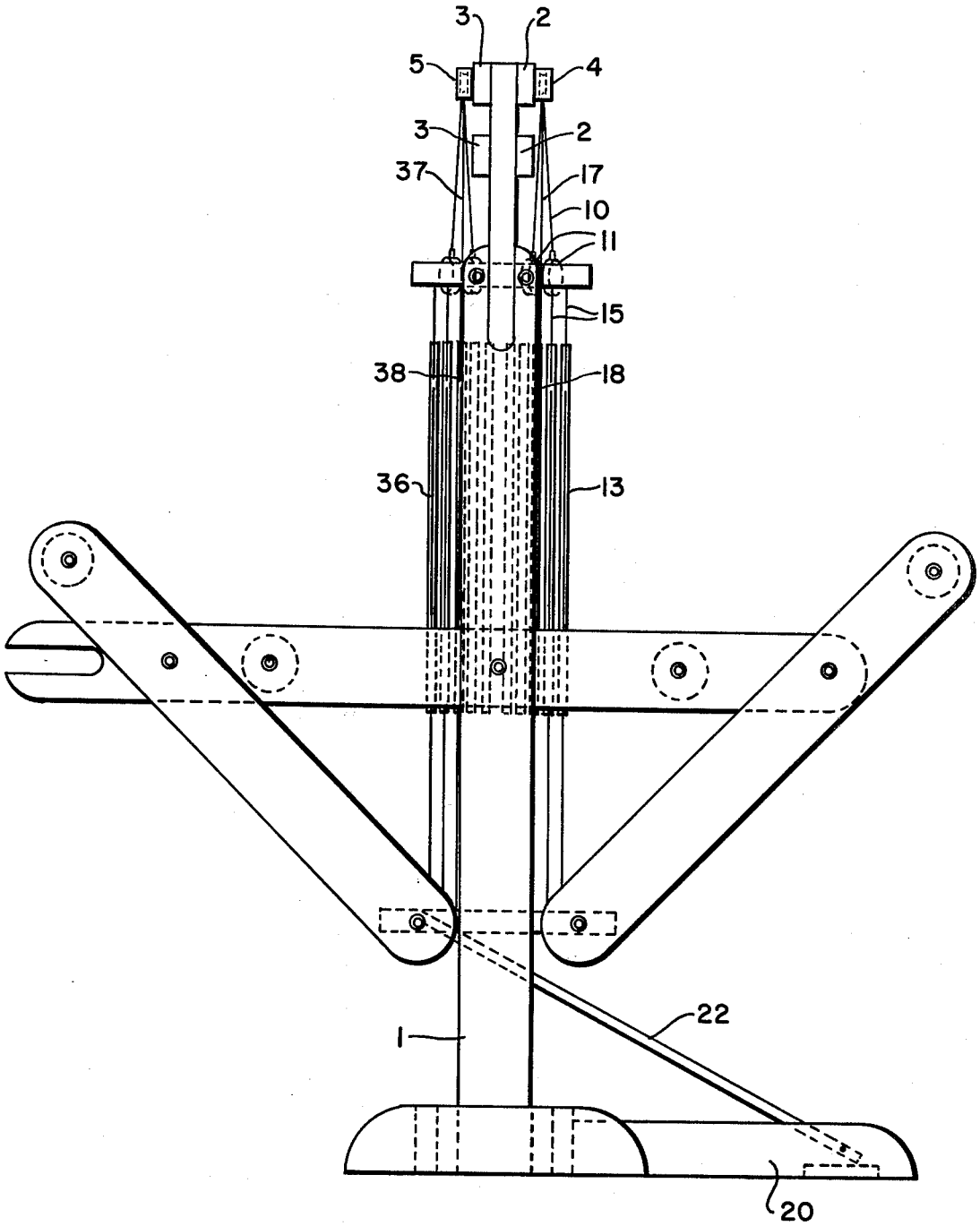
FIG. 3 is a view of the left-hand side of the loom in FIG. 1.

Referring to FIGS. 1, 2 and 3 of the drawings, the loom includes an upright rectangular frame having upright side members 1 connected at their upper ends by horizontal front and back cross bars 2 and 3. Extending lengthwise of the outer sides of the cross bars are front and back levers 4 and 5. The central portion of each lever is connected to the adjoining cross bar by a horizontal pivot 6. One end of each lever is bifurcated and contains a grooved roller that is pivotally connected to it on a horizontal axis. The two rollers 7 and 8 are directly opposite each other.

Only the front lever 4 will now be considered. This lever supports four parallel harnesses below it. This is accomplished by means of an upper cable 10 hanging from roller 7, with its opposite ends supporting a pair of pulleys 11. Hanging from each pulley is an intermediate cable 12, the ends of which are connected to the tops of two of the vertical harness frames 13. Therefore, the two pulleys support the four harnesses. Each harness frame contains the usual heddles 14. As is well known, the heddles are provided with eyes through which the warp threads of the loom extend so that the threads can be raised and lowered by the vertically movable harnesses to form the shed through which the shuttle is projected back and forth in the usual manner. The harnesses can be maintained level in any suitable manner as they move up and down, but preferably by guide cables 15 such as shown in my U.S. Pat. No. 3,774,649.

The end of lever 4 opposite its roller supports the upper end of a cable 17, the lower end of which is connected to the top of a vertically movable connecting member or floater 18. Although this floater may take various forms, it is preferred to use a harness frame 18, minus heddles, shown in FIG. 3. It is located directly below the lever, with two harnesses in front of it and two behind it. The normal position of the lever is horizontal with its roller in a central position as shown in FIG. 1.

To accomplish the vertical movements of the harnesses the loom is provided beneath them with a number of normally raised treadles, each of which is rockably mounted at its lower front end on a forward extension 20 of the base of the loom frame. The number of treadles depends upon the number of different combinations of harness movements that are desired. Five treadles are shown in order to illustrate how five different tie-ups can be made, but in practice all of these tie-ups would not necessarily be in effect at the same time.

Reference will now be made not only to FIG. 1, but also to the diagrams in FIGS. 4 to 10, in which the four harnesses are shown but, only for the sake of clearness, turned 90° to their actual position parallel to floater 18. The loom at rest is indicated in FIG. 4, in which all of the harnesses and the floater are at the same level in a neutral or centered position. A slack cable 21 connects one treadle 22 to the bottom of floater 18. As shown in both FIG. 4 and FIG. 5, cables 23 and 24 connect the same treadle to the bottoms of the two harnesses that it is desired to pull down in a two up and two down tie-up. These can be the two harnesses hanging from a single pulley 11 (FIG. 6), or one harness hanging from each pulley as shown in FIG. 5. Only the cables connected to the bottom of the floater are shown in FIG. 1. None are shown in FIG. 3 to avoid confusion. When treadle 22 is depressed, the two harnesses connected to it by cables 23 and 24 will be lowered and that will cause the intermediate cables 12 to raise the other two harnesses, all as shown in FIG. 5. Cable 21 connected to the floater is of such length that it is pulled taut (FIG. 5) when the treadle is fully depressed, to thereby prevent the harnesses from tilting lever 4 by raising the floater, which would lower roller 7 from its central position.

As an alternate tie-up, the two harnesses suspended from a single pulley 11 can be lowered and the other two can be raised as shown in FIG. 6 by connecting cables 23 and 24 to the first two harnesses. Depression of the treadle will pull the two harnesses down and also pull cable 21 taut to keep lever 4 level. If plain weaving is to be done with the balanced tie-up shown in FIG. 5 or FIG. 6, those familiar with loom operation will understand that the two harnesses shown in the up position in either figure will be connected by cables to another treadle for pulling those two harnesses down and raising the other two to the up position. However, this particular additional tie-up is not required in all cases for the following reason. In every case, as soon as any depressed treadle is released, the tension on the vertically displaced warp threads extending through the harnesses tends to return the harnesses to their FIG. 4 centered position, but with pattern weaving it may not be necessary that thay return because the next treadle that is depressed and that is connected by different cables to the harnesses and floater will move them vertically into the next desired position to form the desired shed.

Thus cables 26, 27 and 28 connect another treadle 29 to the two harnesses suspended from either one of the pulleys and to one of the other harnesses as shown in FIG. 7. When this treadle is depressed, it will lower three harnesses and raise the fourth one. At the same time, the harnesses will pull roller 7 downwardly by tilting the lever as the floater rises. The distance the roller can move down is limited by a cable 30 connecting treadle 29 with floater 18. This cable is of such length that it will become taut when the treadle is fully depressed.

As shown in FIG. 8, a third treadle 32 can be connected by a cable 33 to one harness, and by another cable 34 to the floater to lower the floater and the single harness when the treadle is depressed. The descending floater will pull down on cable 17 and lever 4 and thereby cause roller 7 to rise a predetermined distance from its central position and raise three harnesses.

In each of the above instances in which lever 4 is tilted, its roller 7 is raised or lowered just enough to ensure that the elevated harness or harnesses will rise to the same level as two harnesses are raised in the case of two up and two down. In all cases the lowered harnesses are pulled down to a common level. Consequently, by the use of floater 18 and lever 4, the height of the shed remains uniform, regardless of which harnesses are raised and which are lowered. This gives the loom the advantages of counter-balance weaving, jack-type weaving and counter-marche weaving, without their disadvantages. Although in each of FIGS. 4 and 8 only one cable is shown connecting floater 18 to a treadle, that is only for illustrating the different actions of the loom for different sheds. In practice, cables 21, 30 and 34 will all hang from the floater at the same time if the three tie-ups associated with them are all being used.

Although the loom can be operated with only the front set of harnesses as just described, it is more versatile if it is provided with a rear set of four harnesses 36 (FIG. 3). These harnesses are supported from roller 8 in the same way as the front set, by cables and pulleys. Also, one end of lever 5 is connected by a cable 37 (FIG. 2) to a floater 38 directly below the lever. By connecting a fourth treadle 39 through a cable 40 to only the floater 18 as shown in FIG. 1 and FIG. 9, depression of that treadle will pull one end of lever 4 down and thereby raise roller 7 to lift all four front harnesses 13 simultaneously. The same treadle can be connected by cables to the bottoms of the rear set of harnesses so that they will be pulled down at the same time that the first set is raised. In this procedure the levers are tilted in opposite directions, as indicated in dotted lines in FIG. 2, farther than in the cases explained above, so that the height of the shed will remain the same. Or, if desired, the front harnesses can be raised by treadle 39, which can also be connected with the rear set of harnesses in such a way as to move them into the position shown in FIG. 5, 6, 7 or 8.

Also, as shown in FIG. 10, a fifth treadle 42 is connected by cables 43 to all four front harnesses 13, but this treadle is not connected to floater 18. However, the same treadle can be connected by a cable 44 (FIG. 1) to the rear floater 38 but not the rear set of harnesses. Then, when this treadle is depressed, it will pull the front set of harnesses and the rear floater down and the rear lever 5 will raise the rear set of harnesses. Again, if desired, treadle 42 can be connected with the rear set of harnesses in the way necessary for moving them into the position shown in FIG. 5, 6, 7 or 8.

It will be noted that in FIGS. 7 and 8 roller 7 is raised or lowered to a position between the central position shown in FIG. 4 and the extreme upper and lower positions of FIGS. 9 and 10. Thus, lever 4 can take five different positions during weaving.

Although each tie-up has been described in association with a specific treadle for convenience of explanation, it should be understood that any treadle can be a part of any tie-up. For example, cables 21, 23 and 24 could be connected to treadle 29 and cables 26, 27, 28 and 30 connected to treadle 22.

This loom does not have the disadvantages of conventional weaving modes, but it has all of their advantages. The construction is simpler than heretofore and there are fewer parts. Multiple treadling is possible as well as unbalanced tie-ups and direct tie-ups. The action is smooth, easy and exceptionally quiet.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. In a loom, an upright frame having a horizontal cross bar at its top, a lever extending lengthwise of one side of said cross bar, means pivotally connecting the central portion of the lever to the cross bar on a horizontal axis, a roller pivotally supported by one end of the lever on a horizontal axis and normally held by the lever in a predetermined central position between upper and lower positions, a lever cable hanging from the other end of said lever, a vertically movable floater suspended from the lever cable, an upper cable hanging from said roller, a pulley supported by each end of said upper cable, an intermediate cable hanging from each pulley, a set of four vertically movable parallel harnesses below the pulleys, each harness being suspended from a different end of said intermediate cables, treadles beneath the harnesses and floater, cables for connecting a treadle to two harnesses and said floater to lower those two harnesses and raise the other two, the cable connected to said floater being of a length to be pulled taut when said treadle is fully depressed to maintain said roller in said central position, other cables for connecting a treadle to the two harnesses suspended from one of said pulleys and to one of the other harnesses and said floater for lowering those three harnesses and said roller while raising the other harness, the last-mentioned cable connected to said floater being of a length to be pulled taut when the treadle connected to that cable is fully depressed to limit said lowering of said roller to a predetermined distance between its central and lower positions, and further cables for connecting a treadle to one harness and said floater for lowering that harness and the floater, whereby said other end of said lever is pulled down a predetermined distance as three harnesses are raised and the lever lifts said roller to a position between said central position and upper position.

2. In a loom according to claim 1, each of said harnesses including a rectangular frame around a plurality of vertical heddles, and said floater being a rectangular frame parallel to the harnesses.

3. In a loom according to claim 1, a second lever pivotally mounted at the opposite side of said cross bar, a roller pivotally supported by the end of that lever opposite said first-mentioned roller and normally in a central position between upper and lower positions, a second lever cable hanging from the other end of the second lever, a second vertically movable floater suspended from said second lever cable, a second set of four vertically movable parallel harnesses supported by the second lever roller in the same way as the first set of harnesses is supported from the first-mentioned roller, cables for connecting a treadle to the first-mentioned floater and to at least one of the harnesses of the second set to raise the first set and lower at least one of the harnesses in the second set, and cables for connecting a treadle to said second floater and to at least one of the harnesses of the first set to raise the second set and lower at least one of the harnesses in the first set.

4. In a loom according to claim 3, said cables for connecting a treadle to at least one of the harnesses of the second set being connected to all four of the second set harnesses to lower all four and to lower the roller supported by said second lever to its lower position, and said cables for connecting a treadle to at least one of the harnesses of the first set being connected to all four of the first set harnesses to lower all four and to raise the first roller to its upper position.

* * * * *